United States Patent [19]

Wright et al.

[11] 4,254,596

[45] Mar. 10, 1981

[54] ASSEMBLEABLE MANTELPIECE

[75] Inventors: John D. Wright, Westfield; Peter D. Simpson, Englewood, both of N.J.

[73] Assignee: Rustic Crafts, Englewood, N.J.

[21] Appl. No.: 917,633

[22] Filed: Jun. 21, 1978

[51] Int. Cl.[3] ..... F24B 1/18; F24C 15/12

[52] U.S. Cl. ..... 52/36; 52/218; 126/120; 126/138

[58] Field of Search ..... 126/138, 120; 52/218, 52/36

[56] References Cited

U.S. PATENT DOCUMENTS

| | | | |
|---|---|---|---|
| 269,536 | 12/1882 | Page | 52/36 |
| 591,358 | 10/1897 | Parker | 126/138 X |
| 641,525 | 1/1900 | Lewis | 126/138 X |
| 728,169 | 5/1903 | Holbein | 126/138 X |
| 3,657,848 | 4/1972 | Davidson | 52/36 |
| 3,690,076 | 9/1972 | Harris | 52/36 |

FOREIGN PATENT DOCUMENTS

| | | | |
|---|---|---|---|
| 8553 | 10/1899 | Norway | 52/36 |
| 244377 | 12/1925 | United Kingdom | 126/120 |
| 721113 | 12/1954 | United Kingdom | 126/120 |

*Primary Examiner*—Alfred C. Perham
*Attorney, Agent, or Firm*—Ronald G. Goebel

[57] ABSTRACT

The invention comprises an assembleable mantelpiece, which includes a mantel, a pair of side members, and means for positioning and securing the mantel and pair of side members relative to each other and relative to a fireplace, so as to enable the mantelpiece to be manufactured, shipped and stored disassembled, and assembled and installed relative to a fireplace conveniently and efficiently, without subjecting the mantelpiece to possible damage resulting previously from installation thereof, and without requiring finishing necessary previously as a consequence of such installation thereof.

6 Claims, 5 Drawing Figures

ASSEMBLEABLE MANTELPIECE

BACKGROUND OF THE INVENTION

The invention relates generally to mantelpieces, and relates specifically to an assembleable mantelpiece.

A mantelpiece is a shelf, above a fireplace, with its side elements. Presently known mantelpieces include assembled mantelpieces which are manufactured, assembled, and shipped fully assembled to dealers and distributors. Such assembled mantelpieces, by virtue of their bulk, are susceptible to possible damage during shipment, handling, storage, and installation, are difficult and expensive to package and ship, and take up a large amount of space in a dealer's or distributor's warehouse, making them costly and inefficient to inventory. Other presently known mantelpieces include assembleable mantelpieces which, as with assembled mantelpieces, are installed relative to a fireplace by nailing thereof to the wall, then finishing by covering the nail holes and any dents therein and, in most instances, requiring application of prime and finish coats of paint or stain and lacquer. Such installation of assembled and assembleable mantelpieces to the wall by nailing thereof subjects such mantelpieces to possible damage as a result of hammering thereof, and the additional work required for finishing as a consequence of such installation thereof is inefficient, inconvenient and costly.

SUMMARY OF THE INVENTION

In view of the above, one of the objects of the invention is to provide a mantelpiece which may be conveniently and efficiently manufactured, shipped and stored. A further object of the invention is to provide such a mantelpiece which is conveniently and efficiently positionable and securable relative to a wall and a fireplace, without subjecting the mantelpiece to possible damage resulting previously from hammering thereof, and without requiring finishing necessary previously as a consequence of such installation thereof.

The above objects, as well as others, are provided for in the invention by means of an assembleable mantelpiece, which includes a mantel, a pair of side members, and means for positioning and securing the mantel and pair of side members relative to each other and relative to a fireplace, so as to enable the mantelpiece to be manufactured, shipped and stored disassembled, and assembled and installed relative to a fireplace conveniently and efficiently, without subjecting the mantelpiece to possible damage resulting previously from installation thereof, and without requiring finishing necessary previously as a consequence of such installation thereof.

DESCRIPTION OF THE DRAWINGS

The invention is illustrated, by way of example thereof, in the accompanying drawings, wherein.

DESCRIPTION OF THE PREFERRED EMBODIMENT

Figure 1:
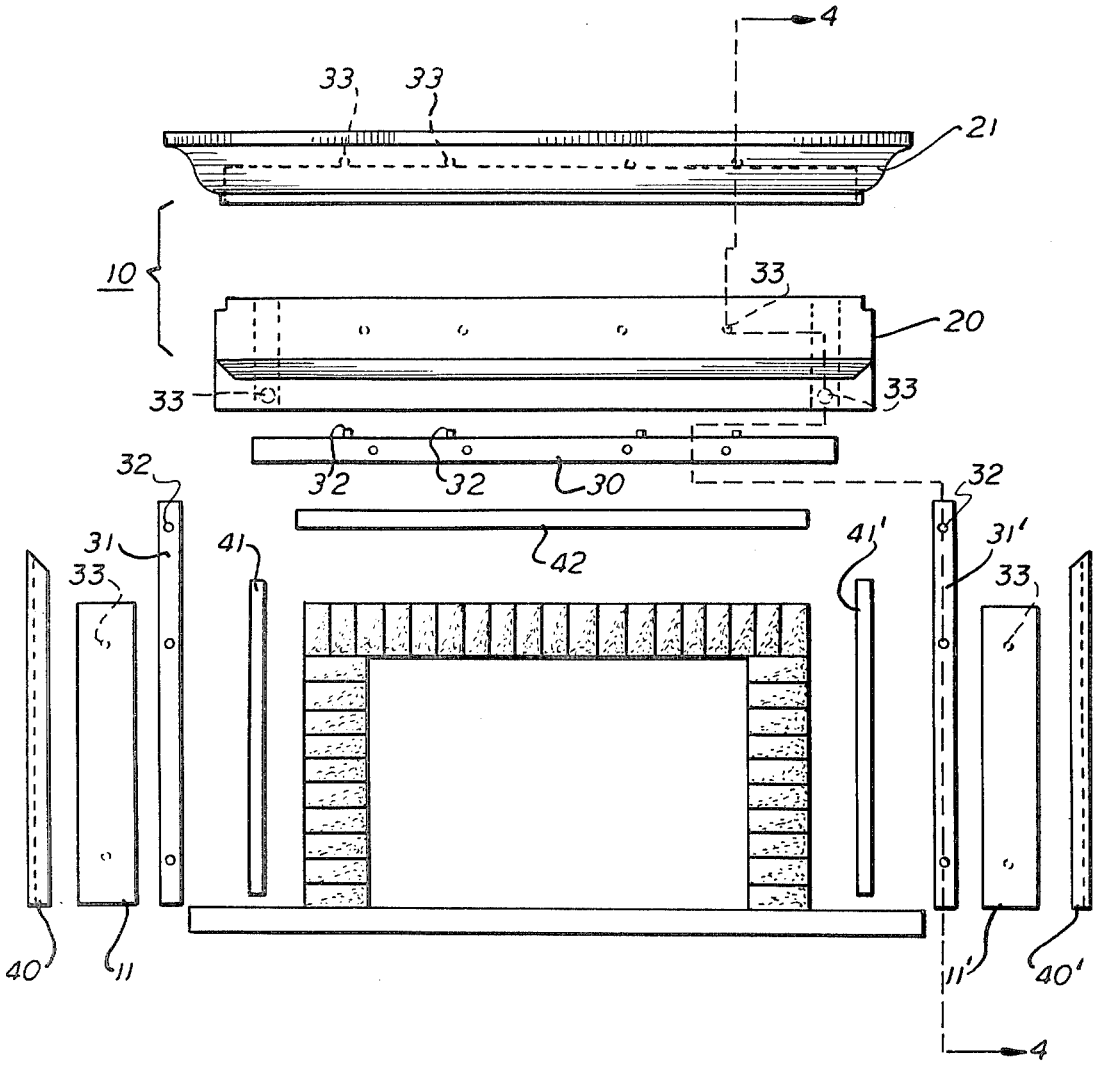
FIG. 1 is a front elevational exploded view of the assembleable mantelpiece, positioned about a fireplace, pursuant to the invention.

The preferred embodiment of the invention, as illustrated in the drawings, comprises, for example, an assembleable mantelpiece, comprising a mantel 10, a pair of side members 11, 11', and means for positioning and securing the mantel 10 and pair of side members 11, 11' in position relative to each other and relative to a fireplace.

The assembleable mantelpiece may be comprised of wood or wood-like material. The fireplace relative to which the assembleable mantelpiece is positioned may comprise a steel form wood-burning fireplace, with a noncombustible course installable about the black surround thereof after the steel form wood-burning fireplace is installed in the desired location thereof.

The mantel 10 comprises a face 20, and a top 21.

The positioning and securing means comprise means for supporting the mantel 10 and pair of side members 11, 11' in position relative to the fireplace, and means for connecting the mantel 10 and pair of side members 11, 11' in position relative to each other. The supporting means comprise a top support 30, and a pair of side supports 31, 31', securable in position relative to the fireplace.

The preferred connecting means comprise snap-lock connectors as described in U.S. Pat. No. 4,012,155 consisting of male and female members capable of lockable engagement. A plurality of male members 32 extend upwardly and frontally on top support 30, and on side supports 31 and 31'. A plurality of female members or openings 33 are located inside top 21, internally across the front of face 20 and at the lower sides thereof and in side members 11 & 11'. Alternatively the male and female members may be reversed in whole or in part on their respective supports, mantel top, face or side members.

The assembleable mantelpiece may further comprise moldings, secureable to the mantel 10 and pair of side members 11, 11'. Such moldings may comprise a pair of decorative outer moldings 40, 40', secureable to the outer sides of the pair of side members 11, 11', a pair of trim inner moldings 41, 41', adjustably positionable relative to the fireplace and secureable to the inner sides of the pair of side members 11, 11', and a trim top molding 42, secureable to the bottom of the mantel 10.

The assembleable mantelpiece mantel 10 face 20 and top 21, top support 30, pair of side supports 31, 31', pair of decorative outer moldings 40, 40', pair of trim outer moldings 41, 41', and trim top molding 42, may be manufactured, shipped and stored disassembled, efficiently and conveniently.

Figure 2:
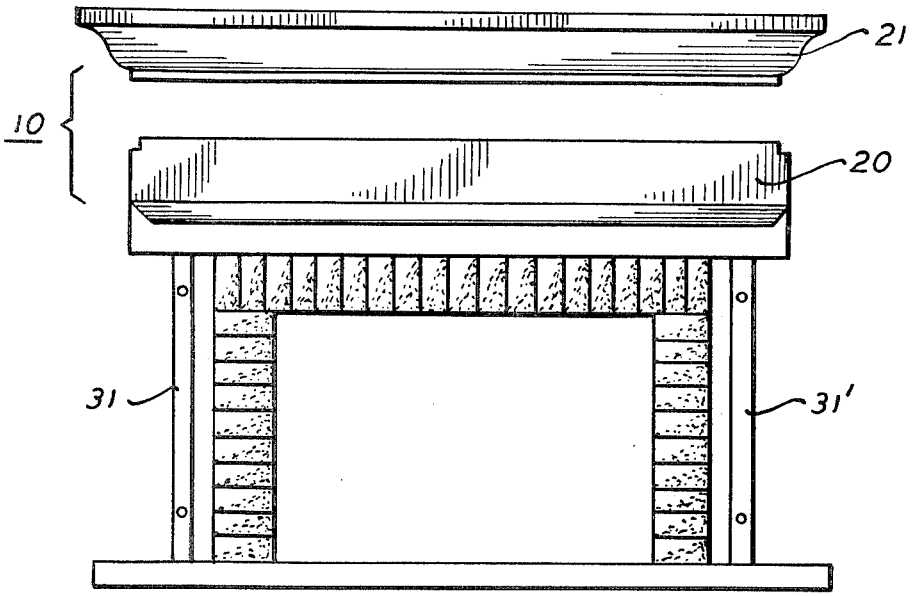
FIG. 2 is a similar view, with the face of the mantel secured to the top support and pair of side supports, pursuant to the invention.
Figure 3:
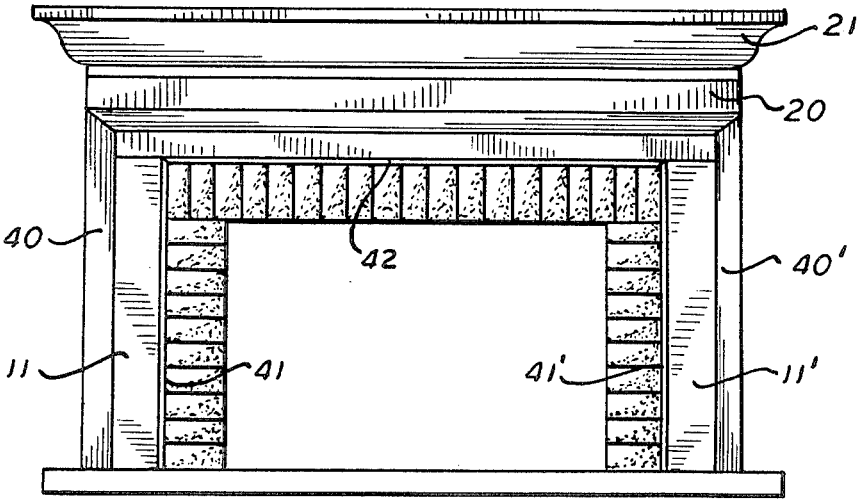
FIG. 3 is a front elevational view of the assembleable mantelpiece, secured in position relative to the fireplace, pursuant to the invention.
Figure 4:
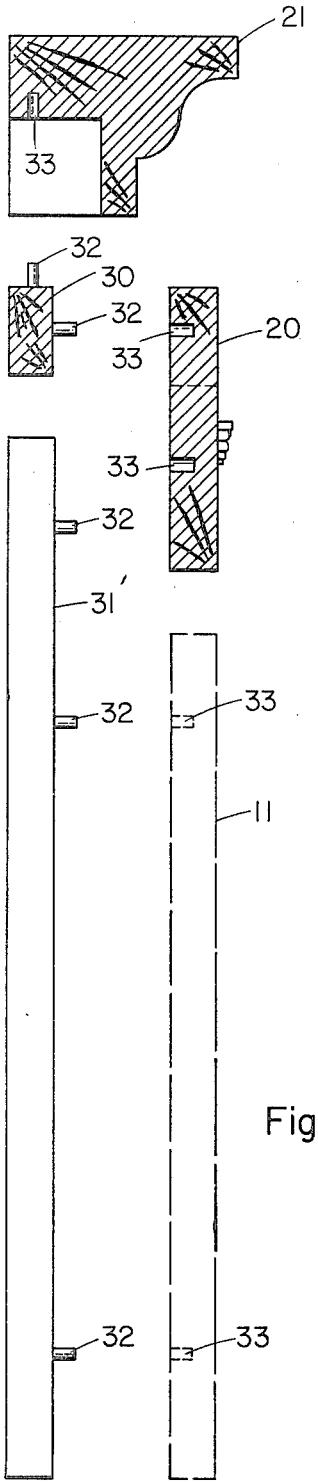
FIG. 4 is a sectional view of the mantelpiece through line 4—4 of FIG. 1.
Figure 5:
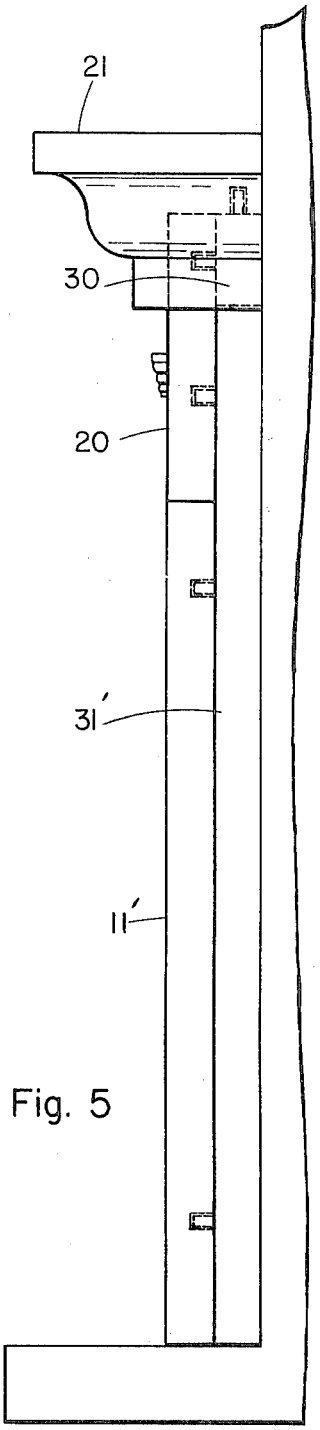
FIG. 5 is a side view of the assembled mantelpiece.

The assembleable mantelpiece may be installed, after installation of the fireplace and the noncombustable course about the surround thereof, by securing the top support 30 and pair of side supports 31, 31' to the wall thereabout, and aligning and pressing the male members 32 extending frontally on top support 30 and the male members 32 at the top of each side support 31 & 31' onto the frontal and pair of side female members 33 on face 20 as shown in FIG. 2; positioning the top 21 over face 20 and pressing the male members 32 extending upwardly from top support 30 into the female openings 33 of said top; and pressing the lower male members 32 of each side support 31 and 31' into the female openings of each side member 11 & 11', efficiently and conveniently, without subjecting the mantelpiece to possible damage resulting previously from hammering thereof, and without requiring finishing necessary previously as a consequence of such installation thereof. The moldings may then be installed by securing the pair of decorative outer moldings 40, 40' to the outer side of the pair of side members 11, 11', securing the trim top molding to the bottom of the face 20, and adjustably positioning the pair of trim inner moldings 41, 41' relative to the backing therefor, as the noncombustable course, and securing the pair of trim inner moldings 41, 41' to the inner sides of the pair of side members 11, 11'.

The preferred embodiment of the invention has been set forth above. It is to be understood, however, that variations may be made in such preferred embodiment, which variations may nevertheless be within the scope and spirit of the invention. The invention is therefor to be broadly construed within the scope and spirit of the claims appended hereto.

We claim:

1. An assembleable mantelpiece securable to a wall surrounding a fireplace without subjecting said mantelpiece to damage during assembly and without requiring further finishing as a consequence of such installation comprising:

(a) a top support securable to said wall having a plurality of top means for lockable connection and frontal means for lockable connection;

(b) a pair of side supports securable to said wall, each support having an upper means for lockable connection and a plurality of lower means for lockable connection;

(c) a face connectable across said top support and an upper portion of said side supports said face having a plurality of internal means for lockably connecting with said plurality of top support frontal means for lockable connection; and said face having side means for lockably connecting with said side support upper means for lockable connection;

(d) a mantel top fitable over said face and connectable with said top support and having a plurality of mantel means for lockably connecting with said top support plurality of top means for lockable connection; and (e) a pair of side members connectable to lower portions of said side support members and having a plurality of side member means for lockably connecting with said plurality of side support member lower means for lockable connection.

2. The assembleable mantelpiece of claim 1 wherein each of said means for lockable connection is either a male or female member of a snap lock connector and each of said means for lockably connecting with said means for lockable connection is either a male or female member of a snap lock connector, the male member of any one of said means lockably connecting with a female member of the other of said means.

3. An assembleable mantelpiece securable to a wall surrounding a fireplace without subjecting said mantelpiece to damage during assembly and without requiring further finishing as a consequence of such installation comprising:

(a) a top support securable to said wall having a plurality of upwardly extending top support male connectors and a plurality of frontal top support female openings;

(b) a pair of side supports securable to said wall, each support having an upper side support male connector and a plurality of lower side support male connectors;

(c) a face connectable across said top support and an upper portion of said side supports said face having a plurality of inwardly extending male face connectors and a pair of face female openings located at the sides of said face, said male face connectors being lockably connectable with said frontal top support female openings and said pair of face female openings being lockably connectable with said upper side support male connectors;

(d) a mantel top fitable over said face and having a plurality of mantel female openings, said mantel female openings being lockably connectable with said upwardly extending top support male connectors; and (e) a pair of side members connectable to said side supports and having a plurality of side member female openings lockably connectable with said lower side support male connectors.

4. The assembleable mantelpiece of claim 3 wherein each of said male connectors is the male member of a snap-lock connector and each of said female openings is the female member of a snap-lock connector.

5. An assembleable mantelpiece securable to a wall surrounding a fireplace without subjecting said mantelpiece to damage during assembly and without requiring further finishing as a consequence of such installation comprising:

(a) a top support securable to said wall having a plurality of upwardly extending top support connectors and a plurality of frontal top support connectors;

(b) a pair of side supports securable to said wall, each support having an upper side support connector and a plurality of lower side support connectors;

(c) a face connectable across said top support and upper portions of said side supports said face having a plurality of internal face openings and a pair of side face openings, said internal face openings being lockably connectable with said frontal top support connectors and said pair of side face openings being lockably connectable with said upper side support connectors;

(d) a mantel top fitable over said face and having a plurality of vertical mantel openings, said mantel openings being lockably connectable with said upwardly extending top support connectors; and (e) a pair of side members connectable to said side supports and having a plurality of side member openings lockably connectable with said lower side support connectors.

6. The assembleable mantelpiece of claim 5 wherein each of said connectors is the male member of a snap lock connector and each of said openings is the female member of a snap lock connector.

* * * * *